US012584669B2

(12) United States Patent
Kyle et al.

(10) Patent No.: US 12,584,669 B2
(45) Date of Patent: Mar. 24, 2026

(54) REFRIGERATION SYSTEM

(71) Applicant: Dyson Technology Limited, Wiltshire (GB)

(72) Inventors: Robert James Kyle, Bristol (GB); Matthew Jerome Jennings, Cheltenham (GB); Matthew Graham Legg, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 139 days.

(21) Appl. No.: 18/288,571

(22) PCT Filed: Apr. 25, 2022

(86) PCT No.: PCT/GB2022/051039
§ 371 (c)(1),
(2) Date: Oct. 26, 2023

(87) PCT Pub. No.: WO2022/229612
PCT Pub. Date: Nov. 3, 2022

(65) Prior Publication Data

US 2024/0210084 A1 Jun. 27, 2024

(30) Foreign Application Priority Data

Apr. 30, 2021 (GB) ..... 2106245

(51) Int. Cl.
*F25B 49/02* (2006.01)

(52) U.S. Cl.
CPC ..... *F25B 49/02* (2013.01); *F25B 2400/0411* (2013.01); *F25B 2600/027* (2013.01); *F25B 2600/2513* (2013.01)

(58) Field of Classification Search
CPC ..... F25B 2400/0411; F25B 2400/24; F25B 2600/027; F25B 2600/2513; F25B 30/02; F25B 49/02
See application file for complete search history.

(56) References Cited

U.S. PATENT DOCUMENTS 2,747,376 A * 5/1956 Muffly ..... F25B 13/00 62/157
2,750,762 A * 6/1956 Coyne ..... F25B 13/00 62/511

(Continued)

FOREIGN PATENT DOCUMENTS

CN 102798214 A 11/2012
CN 204730374 U 10/2015

(Continued)

OTHER PUBLICATIONS

Examination Report received for GB Application No. 2106245.0, mailed on Sep. 15, 2023, 2 pages.

(Continued)

*Primary Examiner* — Henry T Crenshaw
(74) *Attorney, Agent, or Firm* — Tucker Ellis LLP

(57) ABSTRACT

A refrigeration system is described having a circuit around which a refrigerant circulates. The circuit includes a compressor, a metering device, a first heat exchanger for exchanging heat between the refrigerant and a medium, and a second heat exchanger for exchanging heat between the refrigerant and a thermal store. The refrigeration system is operable in a first mode and a second mode. In the first mode, the metering device has a first restriction such that the medium is cooled at the first heat exchanger and the thermal store is heated at the second heat exchanger. In the second mode, the metering device has a second, less restrictive restriction or is bypassed such that the medium is heated at (Continued)

the first heat exchanger and the thermal store is cooled at the second heat exchanger.

14 Claims, 2 Drawing Sheets

(56) References Cited

U.S. PATENT DOCUMENTS

| | | | | |
|---|---|---|---|---|
| 4,646,539 | A * | 3/1987 | Taylor | F25B 47/022 62/278 |
| 5,046,325 | A | 9/1991 | Kuwahara | |
| 2014/0060051 | A1* | 3/2014 | Ohler | F01K 25/06 60/659 |
| 2018/0120873 | A1 | 5/2018 | Radermacher et al. | |
| 2018/0370329 | A1 | 12/2018 | Ishizeki et al. | |
| 2021/0088265 | A1 | 3/2021 | Lin et al. | |
| 2021/0364208 | A1* | 11/2021 | Taras | F25B 39/00 |
| 2024/0210084 | A1* | 6/2024 | Kyle | F25B 30/02 |

FOREIGN PATENT DOCUMENTS

| | | | |
|---|---|---|---|
| CN | 107883602 | A | 4/2018 |
| CN | 110906455 | A | 3/2020 |
| EP | 2884205 | A1 | 6/2015 |
| GB | 2220256 | A | 1/1990 |
| JP | 03-031631 | A | 2/1991 |
| KR | 10-2013-0101261 | A | 9/2013 |
| WO | 00/33002 | A1 | 6/2000 |
| WO | 2014/061132 | A1 | 4/2014 |
| WO | 2019/237705 | A1 | 12/2019 |
| WO | 2020/067189 | A1 | 4/2020 |
| WO | 2021/236517 | A1 | 11/2021 |
| WO | 2022/229612 | A1 | 11/2022 |

OTHER PUBLICATIONS

International Search Report and Written Opinion received for PCT Patent Application No. PCT/GB2022/051039, mailed on Sep. 9, 2022, 16 pages.

Search Report received for GB Application No. 2106245.0, mailed on Oct. 29, 2021, 2 pages.

* cited by examiner

REFRIGERATION SYSTEM

CROSS-REFERENCE TO PRIOR APPLICATIONS

This application is a § 371 National Stage Application of PCT International Application No. PCT/GB2022/051039 filed Apr. 25, 2022, which claims the priority of United Kingdom Application No. 2106245.0, filed Apr. 30, 2021, each of which are herein incorporated by reference in their entirety.

TECHNICAL FIELD

The present invention relates to a refrigeration system.

BACKGROUND

In some refrigeration systems, thermal energy may be transferred between a first heat exchanger and a second heat exchanger via a refrigerant.

SUMMARY

The present invention provides a refrigeration system comprising a circuit around which a refrigerant circulates, the circuit comprising a compressor, a metering device, a first heat exchanger for exchanging heat between the refrigerant and a medium, and a second heat exchanger for exchanging heat between the refrigerant and a thermal store, wherein the refrigeration system is operable in a first mode in which the metering device has a first restriction such that the medium is cooled at the first heat exchanger and the thermal store is heated at the second heat exchanger, and a second mode in which the metering device has a second, less restrictive restriction or is bypassed such that the medium is heated at the first heat exchanger and the thermal store is cooled at the second heat exchanger.

The refrigeration system may therefore be used in the first mode to cool a medium, such as air, at the first heat exchanger, resulting in heat being transferred to the thermal store. The refrigeration system may also be used in a second mode to cool the thermal store, resulting in heat being transferred to the medium at the first heat exchanger. The thermal store is cooled by employing a second, less restrictive restriction at the metering device or by bypassing the metering device thus avoiding the need for a reversible circuit.

The pressure of the refrigerant may be reduced by the metering device in the first mode, and the pressure of the refrigerant may not be reduced by the metering device in the second mode. By reducing the pressure of the refrigerant in the first mode, the temperature of the refrigerant is reduced and cooling may be achieved at the first heat exchanger. By not reducing the pressure in the second mode, the temperature of the refrigerant is unchanged. As a result, heat may be expelled at the first heat exchanger thereby cooling the refrigerant and thus the thermal store at the second heat exchanger. This then differs from a conventional reversible refrigeration cycle in which the pressure is reduced by the metering device in both modes.

The metering device may comprise a variable expansion valve or the refrigeration system may comprise a bypass valve for bypassing the metering device, and the variable expansion valve may have the first restriction or the bypass valve may be closed in the first mode, and the variable expansion valve may have the second, less restrictive restriction or the bypass valve may be open in the second mode. A variable expansion valve, i.e. an expansion valve having a variable restriction, may provide an efficient mechanism for achieving different refrigerant pressures in the two modes, whereas the bypass valve may provide a more cost-effective mechanism.

The present invention also provides a refrigeration system comprising a circuit around which a refrigerant circulates, the circuit comprising a first heat exchanger, a second heat exchanger, a compressor and a metering device, wherein the refrigeration system is operable in a first mode in which a pressure of the refrigerant is reduced by the metering device, and a second mode in which the pressure of the refrigerant is not reduced by the metering device.

The refrigeration system may therefore be used in the first mode to cool a medium, such as air, at the first heat exchanger, resulting in heat being transferred to the thermal store. The refrigeration system may also be used in a second mode to cool the thermal store, resulting in heat being transferred to the medium at the first heat exchanger. The thermal store is cooled by ensuring that the pressure of the refrigerant is not reduced by the metering device. This then differs from a conventional reversible refrigeration cycle in which the pressure is reduced by the metering device in both modes.

The second heat exchanger may exchange heat between the refrigerant and a thermal store. Moreover, the second heat exchanger may heat the thermal store in the first mode and cool the thermal store in the second mode. As a result, cooling may be achieved at the first heat exchanger in the first mode, and heating may be achieved in the second mode.

The metering device may comprise a variable expansion valve or the refrigeration system may comprise a bypass valve for bypassing the metering device, and the variable expansion valve may have a first restriction or the bypass valve may be closed in the first mode, and the variable expansion valve may have a second, less restrictive restriction or the bypass valve may be open in the second mode. A variable expansion valve, i.e. an expansion valve having a variable restriction, may provide an efficient mechanism for achieving different refrigerant pressures in the two modes, whereas the bypass valve may provide a more cost-effective mechanism.

The refrigeration system may comprise the thermal store and the thermal store may comprise a phase change material. As a result, advantage may be taken of the latent heat capacity of the phase change material to store more thermal energy for a given temperature change. As a result, the refrigeration system may provide cooling at the first heat exchanger for a longer period.

The refrigerant may circulate around the circuit in the same direction in both the first mode and the second mode. As a result, the cooling and heating functions of the heat exchangers may be reversed without requiring a four-way valve, thereby simplify the refrigeration system.

The refrigerant may undergo a phase transition in the first mode only. That is to say, there may be no phase transition in the second mode. In particular, the refrigerant may have two states of matter (e.g. liquid and vapour) in the first mode, and a single state of matter in the second mode (e.g. liquid or vapour).

The compressor may drive the refrigerant around the circuit in the first mode and the second mode. Conceivably, the compressor may be powered off in the second mode, and the refrigeration system may rely on convection to drive the refrigerant around the circuit. However, by using the compressor to drive the refrigerant in the second mode, the flow rate of the refrigerant and thus the rate of cooling of the thermal store may be increased.

The refrigeration system may comprise a controller for switching between the first mode and the second mode in response to an input. The controller is then able to control whether heating or cooling occurs at each of the heat exchangers. For example, the controller may switch to the second mode to cool the thermal store when cooling at the first heat exchanger is not required.

The refrigeration system may comprise a temperature sensor for measuring a temperature of the thermal store, and the controller may switch between the first mode and the second mode in response to changes in the temperature of the thermal store as measured by the temperature sensor. The controller may then control the operation of the refrigeration system so as to avoid excessive heating of the thermal store, as well as ineffective or inefficient cooling.

The controller may switch from the first mode to the second mode in response to the temperature of the thermal store exceeding a threshold. The threshold may represent a temperature at which the refrigeration system is no longer able to effectively or efficiently cool the medium at the first heat exchanger.

The input may be provided by at least one of a user interface and a temperature sensor. The user interface may form part of the refrigeration system (e.g. a dedicated interface). Alternatively, the user interface may form part of a separate device, such as a mobile phone, tablet or other computing device, connected to the controller via a wireless interface. Beneficially, this enables a user to control the refrigeration system. For example, a user can specify a target temperature, when cooling of the medium at the first heat exchanger should occur and/or when cooling of the thermal store at the second heat exchanger store should occur.

The temperature sensor may comprise a room thermostat connected to the controller via a wired or wireless interface. This may enable the user to specify a desired room temperature via the thermostat and the refrigeration system to maintain a room at the desired temperature.

The present invention further provides a heating, ventilation and air conditioning (HVAC) system comprising a refrigerant system according to any one of the preceding paragraphs.

BRIEF DESCRIPTION OF THE DRAWINGS

Embodiments will now be described, by way of example, with reference to the accompanying drawings in which.

DETAILED DESCRIPTION

Figure 1:
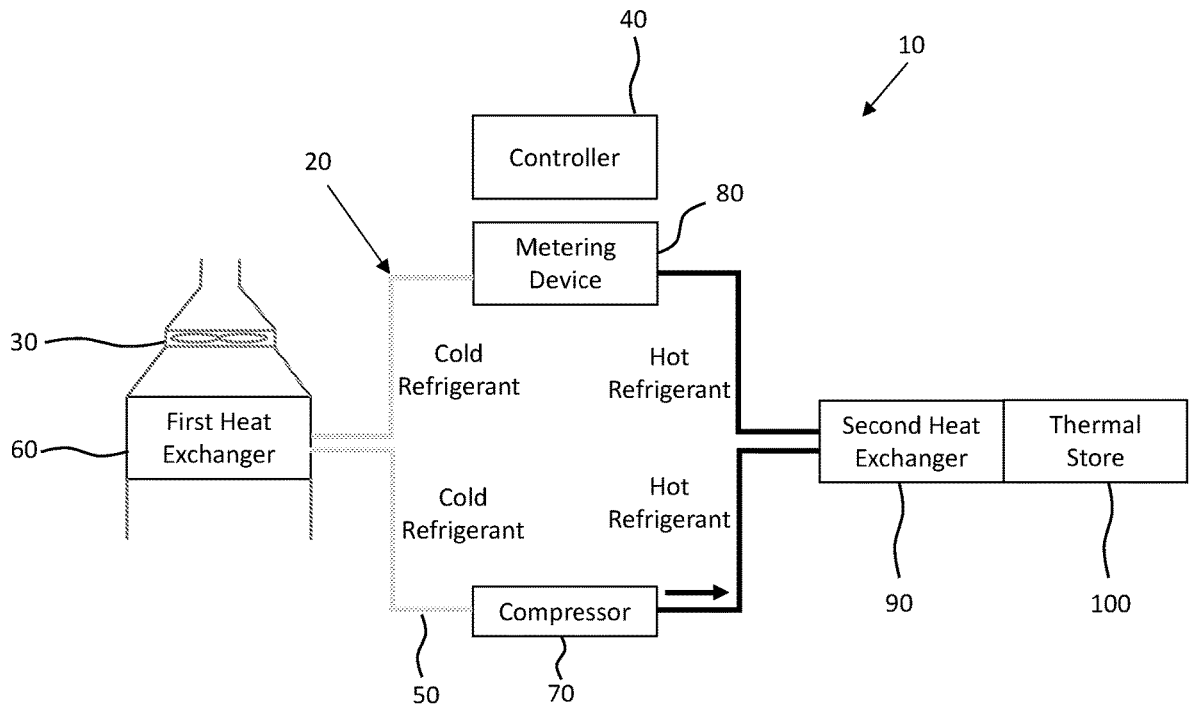
FIG. 1 shows a schematic of a refrigeration system in a first mode.
Figure 2:
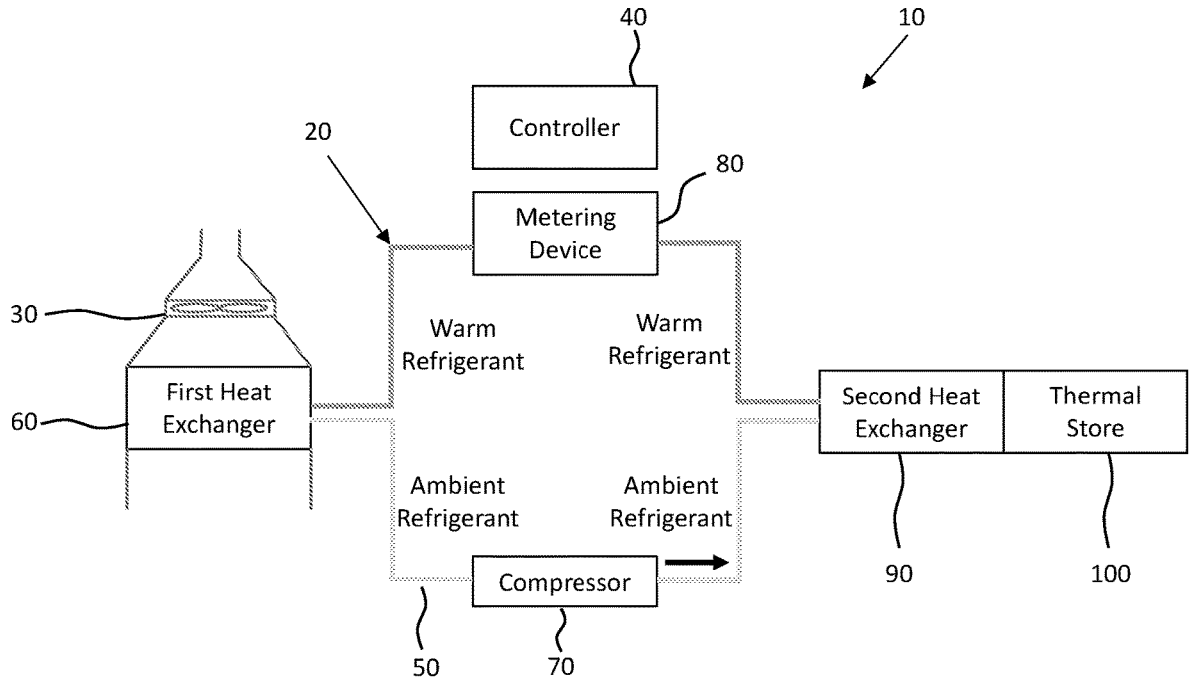
FIG. 2 shows a schematic of the refrigeration system of FIG. 1 in a second mode.

FIGS. 1 and 2 show an example refrigeration system 10 comprising a circuit 20, a blower 30 and a controller 40. The circuit 20 comprises a series of pipes 50, a first heat exchanger 60, a compressor 70, a metering device 80, a second heat exchanger 90, and a thermal store 100.

The series of pipes 50 connect the first heat exchanger 60 to the compressor 70, the compressor 70 to the second heat exchanger 90, the second heat exchanger 90 to the metering device 80 and the metering device 80 to the first heat exchanger 60 such that a refrigerant can circulate around the circuit 20.

The first heat exchanger 60 is located downstream of the metering device 80 and upstream of the compressor 70, and exchanges heat between the refrigerant and air. The second heat exchanger 90 is downstream of the compressor 70 and upstream of the metering device 80, and exchanges heat between the refrigerant and the thermal store 100.

The compressor 70 drives the refrigerant around the circuit 20 in a direction, shown in FIG. 1, such that the refrigerant circulates from the compressor 70 to the second heat exchanger 90, from the second heat exchanger 90 to the metering device 80, from the metering device 80 to the first heat exchanger 60 and from the first heat exchanger 60 to the compressor 70. In some modes of operation, discussed subsequently, the compressor 70 may additionally compress the refrigerant.

The metering device 80 is operable in a restricted state and an unrestricted state. In the restricted state, the refrigerant flowing through the metering device 80 expands and the pressure and temperature of the refrigerant decreases. In the unrestricted state, the refrigerant flowing through the metering device 80 does not expand and the pressure and temperature of the refrigerant is unchanged. In this example, the metering device 80 comprises a variable expansion valve. In the restricted state, the variable expansion valve has a first restriction, and in the unrestricted state, the variable expansion valve has a second, less restrictive restriction.

The thermal store 100 stores thermal energy for transfer to and from the refrigerant in order to heat and cool the refrigerant. In this particular example, the thermal store 100 comprises a phase change material. This then has the benefit that the thermal store 100 can take advantage of the latent heat capacity of the phase change material to store more thermal energy for a given change in temperature. In one example, the phase change material may be an organic wax or inorganic salt hydrate having a melting point of between 45° C. and 50° C.

The blower 30 comprises a fan driven by a motor for blowing air over the first heat exchanger 60.

The controller 40 controls the compressor 70, the metering device 80 and the blower 30. For example, the controller 40 may power on and off the compressor 70 and the blower 30, as well as control the state of the metering device 80. The controller 40 may additionally control the speed of the compressor 70 and/or the blower 30.

The refrigeration system 10, under the control of the controller 40, is operable in a first mode and a second mode.

In the first mode, shown in FIG. 1, the controller 40 moves the metering device 80 to the restricted state and operates the blower 30 at a first speed. As a consequence of the metering device 80 being in the restricted state, the pressure and temperature of the refrigerant flowing though the metering device 80 decreases. In this particular example, the refrigerant remains in the liquid state, but could conceivably undergo a phase transition from a liquid state to a liquid-vapour state. The refrigerant flowing through the first heat exchanger 60 is at a lower temperature than the air moving over the first heat exchanger 60. Consequently, the first heat exchanger 60 acts as an evaporator to cool the air, and heat and vaporise the refrigerant. The refrigerant therefore undergoes a phase transition from a liquid state to a vapour state. The refrigerant then flows from the first heat exchanger 60 to the compressor 70, whereupon the refrigerant is compressed to increase the pressure, and thus the temperature, of the refrigerant. The refrigerant then flows through the second heat exchanger 90, which exchanges heat between the refrigerant and the thermal store 100. The refrigerant flowing through the second heat exchanger 90 is at a higher temperature than the thermal store 100. As a result, the second heat exchanger 90 acts as a condenser to heat the thermal store 100, and cool and condense the refrigerant. The refrigerant therefore undergoes a phase transition from a vapour state to a liquid state. The refrigerant then flows to the metering device 80, and the cycle is repeated.

In the second mode, shown in FIG. 2, the controller 40 moves the metering device 80 to the unrestricted state and operates the blower 30 at a second speed. As a consequence of the metering device 80 being in the unrestricted state, the pressure and temperature of the refrigerant flowing though the metering device 80 is unchanged. In this particular example, the refrigerant is in a vapour state, but could conceivably be in a liquid-vapour or a liquid state. Refrigerant flowing through the first heat exchanger 60 is at a higher temperature than the air moving over the first heat exchanger 60. Consequently, the air is heated, and the refrigerant is cooled. In this particular example, the refrigerant is not cooled below its boiling point and thus the refrigerant does not condense or undergo a phase change. The refrigerant then flows from the first heat exchanger 60 to the compressor 70. Owing to the unrestricted state of the metering device 80, the compressor 70 does not compress the refrigerant. The refrigerant then flows through the second heat exchanger 90, which exchanges heat between the refrigerant and the thermal store 100. The refrigerant flowing through the second heat exchanger 90 is at a lower temperate than the thermal store 100. As a result, the thermal store 100 is cooled, and the refrigerant is heated. In this particular example, the refrigerant flowing through the second heat exchanger 90 is in a vapour state and does not therefore undergo a phase transition. The refrigerant then flows to the metering device 80, and the cycle is repeated.

The controller 40 switches between the first mode and the second mode in response to an input. In this example, the refrigeration system 10 comprises a temperature sensor for measuring a temperature of the thermal store 100 and the controller 40 switches between the first mode and the second mode in response to changes in the temperature of the thermal store 100 as measured by the temperature sensor. In particular, the controller 40 switches to the second mode in response to the temperature of the thermal store 100 exceeding an upper threshold. The bigger the difference in the temperatures of the first and second heat exchangers (i.e. the hot and cold sides of the refrigeration system), the less efficient the system becomes. The upper threshold may therefore represent a temperature above which the refrigeration system 10 is no longer able to effectively or efficiently cool the air. Alternatively, the upper threshold may represent a temperature above which the volume expansion of the thermal store becomes excessive, or the temperature of the thermal store becomes excessively hot, which may present a safety concern or may lead to adverse changes in the physical and/or chemical properties of the thermal store. Moreover, the upper threshold may represent a temperature above which the pressure of the refrigerant becomes excessive. The controller 40 then switches to the first mode in response to the temperature of the thermal store 100 being below a lower threshold. As noted above, the efficiency of the refrigeration system increases as the difference in the temperatures of the first and second heat exchangers decreases. The lower threshold may therefore represent a temperature below which the refrigeration system 10 is able to effectively or efficiently cool the air. Where the thermal store comprises a phase change material, the upper and lower thresholds may be respectively greater and lower than the melting point of the phase change material. For example, where the phase change material has a melting point of 46° C., the upper threshold may be 48° C. and the lower threshold may be 44° C. Thereby the refrigeration system 10 operates in the first mode to cool the air at the first heat exchanger 60 and heat the thermal store at the second heat exchanger 90. The refrigeration system 10 operates in the first mode until the temperature of the thermal store exceeds the upper threshold. The refrigeration system 10 then switches to the second mode to heat the air at the first heat exchanger 60 and cool the thermal store 100 at the second heat exchanger 90. The refrigeration system 10 continues to operate in the second mode until the temperature of the thermal store 100 drops below the lower threshold, at which point the refrigeration system 10 switches to the first mode.

In a further example, the input may be provided by a user interface. The user interface may form part of the refrigeration system 10 (e.g. a dedicated interface) or the user interface may form part of a separate device, such as a mobile phone, tablet or other computing device, connected to the controller 40 via a wireless interface. A user is thereby able to control the refrigeration system 10. In one example, the user can specify a target temperature for the air, and the controller 40 may operate the refrigeration system 10 so as to maintain the air at the target temperature. In a second example, the user may schedule times when cooling is desired (e.g. during the day time), and the controller 40 may switch the refrigeration system to the first mode to cool the air when cooling is scheduled, and switch the refrigeration system to the second mode to cool the thermal store 100 when cooling is not scheduled (e.g. overnight). In a third example, geofencing may be employed such that when the user is at home, the controller 40 switches the refrigeration system 10 to the first mode, and when the user is away from home, the controller 40 switches the refrigeration system 10 to the second mode. The user interface may also be used, for example, to adjust or control the speed of the blower 30.

The input could also be provided by a temperature sensor such as a room thermostat. The controller 40 may turn the refrigeration system 10 on and off in response to changes in the air temperature such that the refrigeration system 10 maintains a room at the desired temperature.

With the refrigeration system 10 described above, air is cooled at the first heat exchanger 60 and the thermal store 100 is heated at the second heat exchanger 90 when operating in the first mode. The air is cooled at the first heat exchanger 60 by employing a first restriction at the metering device 80, which reduces the pressure and thus the temperature of the refrigerant. When operating in the second mode, air is heated at the first heat exchanger 60 and the thermal store 100 is cooled at the second heat exchanger 90. The thermal store 100 is cooled by employing a second, less restrictive restriction at the metering device 80, which does not reduce the pressure of the refrigerant. With conventional refrigeration cycles, heating and cooling of a thermal store may be achieved by having a reversible refrigerant flow, typically requiring a four-way valve or the like. With the refrigeration system 10 described above, refrigerant circulates around the circuit 20 in the same direction in both the first mode and the second mode. In particular, the compressor 70 drives the refrigerant around the circuit 20 in the same direction in both modes. As a result, heating and cooling of the thermal store 100 may be achieved without the need for a four-way valve. A potential drawback of the refrigeration system 10 is that the rate of cooling of the thermal store 100 is likely to be lower than that which can be achieved with a reversible refrigeration cycle. However, this potential drawback may be offset by the cost-savings that can be achieved through the omission of a four-way valve.

The thermal store 100 may comprise a phase change material. This then enables advantage to be taken of the latent heat capacity of the phase change material to store more thermal energy for a given temperature change. As a result, the refrigeration system 10 may provide cooling at the first heat exchanger 60 for a longer period. Nevertheless, the refrigeration system may operate with a thermal store 100 that does not comprise a phase change material.

The refrigerant undergoes a phase transition in the first mode only. However, other embodiments are envisaged in which the refrigerant undergoes a phase transition in the second mode.

In the example described above, the metering device 80 has an unrestricted state in the second mode. As a result, the pressure and temperature of the refrigerant at the metering device 80 is unchanged. This effect, namely no change in pressure or temperature at the metering device 80, can be achieved by other means. For example, as will now be described with reference to FIGS. 3 and 4, the refrigeration system may comprise a bypass valve for bypassing the metering device in the second mode.

Figure 3:
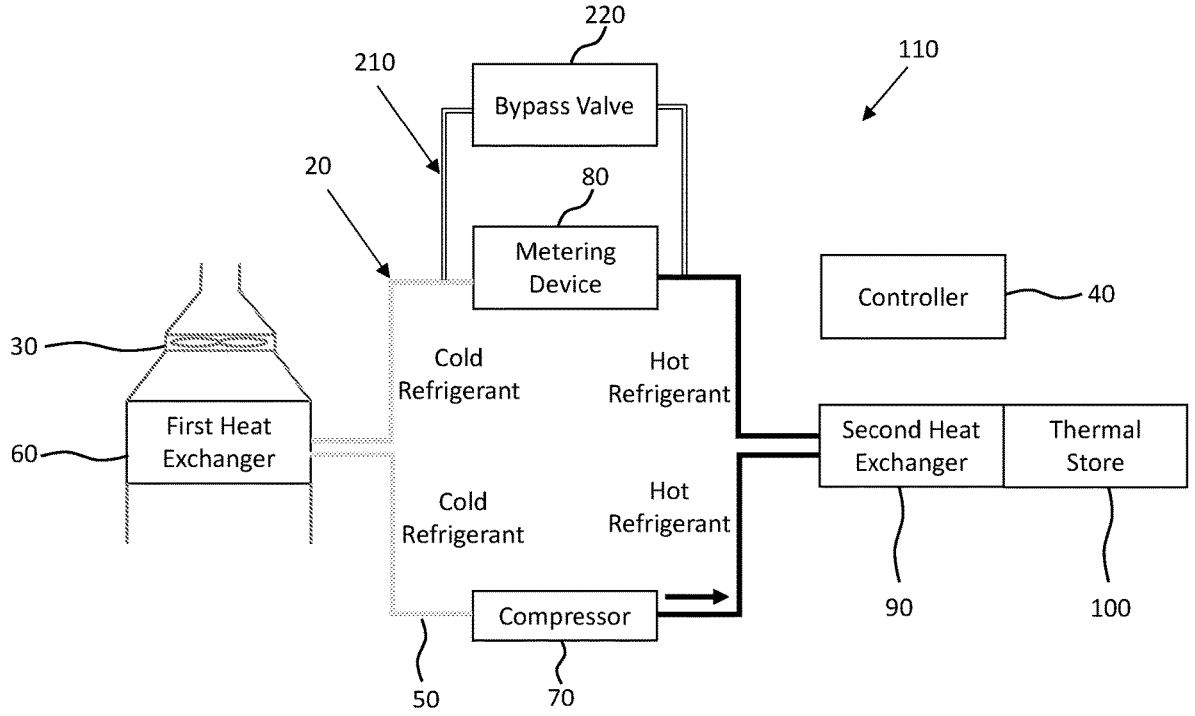
FIG. 3 shows a schematic of an alternative refrigeration system in a first mode.
Figure 4:
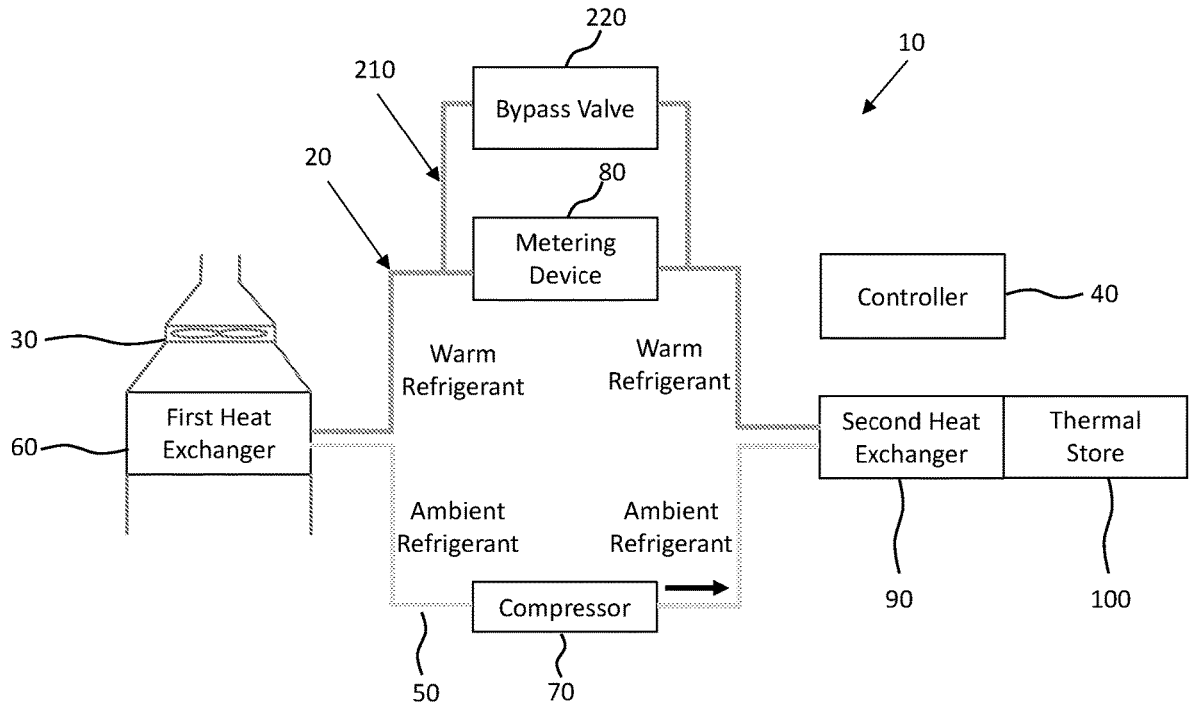
FIG. 4 shows a schematic of the alternative refrigeration system of FIG. 3 in a second mode.

FIGS. 3 and 4 show a further example of a refrigeration system 110. The refrigeration system 110 is identical to that described above and shown in FIGS. 1 and 2, with two exceptions. First, the metering device 80 has a restricted state only, i.e. the metering device 80 does not have an unrestricted state. When refrigerant flows through the metering device 80, the refrigerant expands and the pressure and temperature of the refrigerant decrease. In this example, the metering device 80 comprises a capillary tube that provides a restriction in the circuit 20. Second, the refrigeration system 110 comprises a bypass loop 210.

The bypass loop 210 comprises a first pipe, a second pipe and a bypass valve 220. The first pipe connects the bypass valve 220 to the circuit 20 between the metering device 80 and the second heat exchanger 90, and the second pipe connects the bypass valve 220 to the circuit 20 between the metering device 80 and the first heat exchanger 60. The bypass valve 220 is operable in a closed state and an open state. In the closed state, refrigerant flows through the metering device 80 whereupon the refrigerant expands and the pressure and temperature of the refrigerant decreases. In the open state, refrigerant flows through the bypass loop 210 to bypass the metering device 80. Thereby, the refrigerant does not expand, and the temperature and pressure of the refrigerant is unchanged. In this particular example, the bypass valve 220 comprises a solenoid for moving the bypass valve 220 between the closed state and the open state under the control of the controller 40.

The refrigeration system 110 is again operable in a first mode and a second mode.

In the first mode, shown in FIG. 3, the controller 40 moves the bypass valve 220 to the closed state such that the refrigerant flows through the metering device 80. As a consequence of the metering device 80 having a restriction, the pressure and temperature of the refrigerant flowing though the metering device 80 decreases. In this particular example, the refrigerant remains in the liquid state, but could conceivably undergo a phase transition from a liquid state to a liquid-vapour state. The refrigerant flowing through the first heat exchanger 60 is at a lower temperature than the air moving over the first heat exchanger 60. Consequently, the first heat exchanger 60 acts as an evaporator to cool the air, and heat and vaporise the refrigerant. The refrigerant therefore undergoes a phase transition from a liquid state to a vapour state. The refrigerant then flows from the first heat exchanger 60 to the compressor 70, whereupon the refrigerant is compressed to increase the pressure, and thus the temperature, of the refrigerant. The refrigerant then flows through the second heat exchanger 90, which exchanges heat between the refrigerant and the thermal store 100. The refrigerant flowing through the second heat exchanger 90 is at a higher temperature than the thermal store 100. As a result, the second heat exchanger 90 acts as a condenser to heat the thermal store 100, and cool and condense the refrigerant. The refrigerant therefore undergoes a phase transition from a vapour state to a liquid state. The refrigerant then flows to the metering device 80, and the cycle is repeated.

In the second mode, shown in FIG. 4, the controller 40 moves the bypass valve 220 to the open state such that the refrigerant flows through the bypass loop 210 and bypasses the metering device 80. As a consequence of the refrigerant bypassing the metering device 80, the pressure and temperature of the refrigerant flowing though the bypass loop 210 is unchanged. In this particular example, the refrigerant is in a vapour state. Refrigerant flowing through the first heat exchanger 60 is at a higher temperature than the air moving over the first heat exchanger 60. Consequently, the air is heated and the refrigerant is cooled. In this particular example, the refrigerant is not cooled below its boiling point and thus the refrigerant does not condense or undergo a phase change. The refrigerant then flows from the first heat exchanger 60 to the compressor 70. Owing to refrigerant bypassing the metering device 80, the compressor 70 does not compress the refrigerant but instead acts to drive the refrigerant around the circuit 20. The refrigerant then flows through the second heat exchanger 90, which exchanges heat between the refrigerant and the thermal store 100. The refrigerant flowing through the second heat exchanger 90 is at a lower temperate than the thermal store 100. As a result, the thermal store 100 is cooled, and the refrigerant is heated. In this particular example, the refrigerant flowing through the second heat exchanger 90 is in a vapour state and does not therefore undergo a phase transition. The refrigerant then flows to the bypass loop 210, and the cycle is repeated.

The refrigeration system 110 of FIGS. 3 and 4 thereby realises the same benefits as the refrigeration system 10 of FIGS. 1 and 2. In contrast to the refrigeration system 10 of FIGS. 1 and 2, in which the metering device 80 comprises a variable expansion valve, the refrigeration system 110 comprises a bypass valve 220 for bypassing the metering device 80. A variable expansion valve may provide an efficient mechanism for achieving different refrigerant pressures in the two modes, whereas the bypass valve 220 may provide a more cost-effective mechanism.

In the above examples, the pressure and temperature of the refrigerant are not reduced by the metering device 80 in the second mode. However, it is conceivable that the pressure and temperature of the refrigerant may be reduced by the metering device 80 in the second mode by a small amount providing that refrigerant flowing through the first heat exchanger 60 is at a higher temperature than the air. However, this may result in the effectiveness with which the refrigeration system 10,110 may cool the air at the first heat exchanger 60 in the first mode being reduced.

In the examples described above, the refrigeration system is used to cool air at the first heat exchanger 60. However, the refrigeration system 10,110 may be used to cool an alternative medium at the first heat exchanger 60, such as another gas or a liquid. Additionally, whilst the above examples comprise a blower 30, the blower 30 may be omitted and other mechanisms, such as convection or a pump, may be relied upon to move the medium over the first heat exchanger 60.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A refrigeration system comprising a circuit around which a refrigerant circulates, the circuit comprising:
- a compressor;
- a metering device;
- a first heat exchanger for exchanging heat between the refrigerant and a medium;
- a second heat exchanger for exchanging heat between the refrigerant and a thermal store, wherein the refrigeration system is operable in:
  - a first mode in which the metering device has a first restriction such that the medium is cooled at the first heat exchanger and the thermal store is heated at the second heat exchanger; and
  - a second mode in which the metering device has a second, less restrictive restriction or is bypassed such that the medium is heated at the first heat exchanger and the thermal store is cooled at the second heat exchanger;
- a controller for switching between the first mode and the second mode in response to an input; and
- a temperature sensor for measuring a temperature of the thermal store, wherein the controller switches between the first mode and the second mode in response to changes in the temperature of the thermal store as measured by the temperature sensor.

2. The refrigeration system as claimed in claim 1, wherein a pressure of the refrigerant is reduced by the metering device in the first mode, and the pressure of the refrigerant is not reduced by the metering device in the second mode.

3. The refrigeration system as claimed in claim 1, wherein the metering device comprises a variable expansion valve or the refrigeration system comprises a bypass valve for bypassing the metering device, and the variable expansion valve has the first restriction or the bypass valve is closed in the first mode, and the variable expansion valve has the second, less restrictive restriction or the bypass valve is open in the second mode.

4. A refrigeration system comprising a circuit around which a refrigerant circulates, the circuit comprising:
- a first heat exchanger;
- a second heat exchanger, wherein the second heat exchanger exchanges heat between the refrigerant and a thermal store;
- a compressor;
- a metering device, wherein the refrigeration system is operable in a first mode in which a pressure of the refrigerant is reduced by the metering device, and a second mode in which the pressure of the refrigerant is not reduced by the metering device;
- a controller for switching between the first mode and the second mode in response to an input; and
- a temperature sensor for measuring a temperature of the thermal store, wherein the controller switches between the first mode and the second mode in response to changes in the temperature of the thermal store as measured by the temperature sensor.

5. The refrigeration system as claimed in claim 4, wherein the second heat exchanger heats the thermal store in the first mode, and the second heat exchanger cools the thermal store in the second mode.

6. The refrigeration system as claimed in claim 4, wherein the metering device comprises a variable expansion valve or the refrigeration system comprises a bypass valve for bypassing the metering device, and the variable expansion valve has a first restriction or the bypass valve is closed in the first mode, and the variable expansion valve has a second, less restrictive restriction or the bypass valve is open in the second mode.

7. The refrigeration system as claimed in claim 1, wherein the refrigeration system comprises the thermal store and the thermal store comprises a phase change material.

8. The refrigeration system as claimed in claim 1, wherein the refrigerant circulates around the circuit in the same direction in both the first mode and the second mode.

9. The refrigeration system as claimed in claim 1, wherein the refrigerant undergoes a phase transition in the first mode only.

10. The refrigeration system as claimed in claim 1, wherein the compressor drives the refrigerant around the circuit in the first mode and the second mode.

11. The refrigeration system as claimed in claim 1, wherein the controller switches from the first mode to the second mode in response to the temperature of the thermal store exceeding a threshold.

12. The refrigeration system as claimed in claim 1, wherein the input is provided by a user interface and the temperature sensor.

13. An HVAC system comprising the refrigeration system as claimed in claim 1.

14. A method for operating a circuit around which a refrigerant circulates, the circuit comprising:
- a compressor;
- a metering device;
- a first heat exchanger for exchanging heat between the refrigerant and a medium; and
- a second heat exchanger for exchanging heat between the refrigerant and a thermal store;

the method comprising:
- operating the circuit in a first mode in which the metering device has a first restriction such that the medium is cooled at the first heat exchanger and the thermal store is heated at the second heat exchanger; and
- operating the circuit in a second mode in which the metering device has a second, less restrictive restriction or is bypassed such that the medium is heated at the first heat exchanger and the thermal store is cooled at the second heat exchanger,
- wherein the refrigerant circulates around the circuit in the same direction in both the first mode and the second mode, and wherein the refrigerant undergoes a phase transition in the first mode only.

* * * * *